United States Patent [19]

Cea

[11] Patent Number: 4,823,489

[45] Date of Patent: Apr. 25, 1989

[54] METHOD OF MAKING A THREE DIMENSIONAL COMPOSITE DISPLAY CARD

[75] Inventor: Gary L. Cea, Salem, Oreg.

[73] Assignee: Richard Bryan Phipps, Salem, Oreg.

[21] Appl. No.: 119,050

[22] Filed: Nov. 10, 1987

[51] Int. Cl.[4] ..... G09F 1/00

[52] U.S. Cl. ..... 40/124.1; 40/615

[58] Field of Search ..... 40/630, 615, 616, 584, 40/124.1, 594; 428/913.3, 79; 283/75, 101; D19/6, 1; D20/40

[56] References Cited

U.S. PATENT DOCUMENTS

| | | | |
|---|---|---|---|
| D. 63,105 | 10/1923 | King | D19/6 |
| 1,405,635 | 2/1922 | Stanley | 40/616 |
| 1,850,857 | 3/1932 | Weindel, Jr. | 40/615 |
| 3,280,488 | 10/1966 | Rubin | 40/1.5 |
| 3,480,500 | 11/1969 | Hotter | 40/124.1 |
| 4,459,772 | 7/1984 | Kanzelberger | 428/913.3 |

*Primary Examiner*—Robert P. Swiatek

*Assistant Examiner*—Cary E. Stone

*Attorney, Agent, or Firm*—Klarquist, Sparkman, Campbell, Leigh & Whinston

[57] ABSTRACT

A three dimensional composite display card is disclosed which includes multiple components of different materials. The first component consists of a planar backing member optionally including decorative printing thereon. Secured to the backing member is a planar metallic member smaller in size than the backing member, and engraved on one side. These components are secured together using an adhesive material, preferably dual-sided tape. The tape is smaller than the metallic member so as to obscure it from view in the assembled product. Adhesion is accomplished in a manner wherein the metallic member and backing member are parallel to each other. This enables the completed unit to be inserted in a card, envelope, or the like. The resulting product has a unique three-dimensional appearance, is durable in construction, and may be made in a variety of sizes.

11 Claims, 1 Drawing Sheet

METHOD OF MAKING A THREE DIMENSIONAL COMPOSITE DISPLAY CARD

BACKGROUND OF THE INVENTION

The present invention generally relates to a multi-component decorative display card, and more particularly to such a display card having an engraved metal portion adhered to a flexible backing member to produce a product of unique design and visual appeal.

Special occasions including birthdays, conventions, weddings and graduations have created the need for distinctive and attractive announcement cards. To satisfy that need, a variety of decorative cards have been developed. For example, a plurality of design patents exist which involve decorative, one-dimensional display cards. U.S. Design Pat. No. 56,765 to Prince discloses a card having an olive drab border with a green center portion surrounded by a black outline. U.S. Design Pat. No. 63,105 to King discloses a one-dimensional card having an oval design. U.S. Design Pat. No. 40,013 to Soltmann et al discloses a card having a plurality of geometric shapes.

Other cards have been developed which use more ornate design systems. For example, U.S. Pat. No. 2,298,364 to Gits et al discloses a name plate having a base portion and a raised letter portion. The raised letter portion is formed by injecting a plastic material through openings in the base portion.

U.S. Pat. No. 1,863,633 to Melind discloses a name plate including a wooden base having a planar front portion. Positioned on the front portion is a strip of cardboard bearing a person's name or other data. Over the cardboard is a cover of transparent celluloid.

U.S. Pat. No. 259,491 to Church discloses a sign having a panel section which is impressed with a die or mold to form the final product.

U.S. Pat. No. 3,940,864 to Kanzelberger discloses a complex process for imprinting plastic plates using a foil overlay which is subsequently hot stamped to produce the final product.

Notwithstanding the inventions described above, a need exists for a decorative display system which is sufficiently attractive for use at formal occasions. The present invention involves a multi-component display card of unique design and appearance which is suitable for this purpose.

SUMMARY OF THE INVENTION

It is an object of the present invention to provide a composite display card which is characterized by a unique visual appearance.

It is another object of the invention to provide a composite display card which includes multiple components of different materials, and is three dimensional in character.

It is a still further object of the invention to produce a composite display card which is manufactured from inexpensive, readily-available materials.

It is a still further object of the invention to provide a composite display card which is readily manufactured under mass-production conditions.

It is a still further object of the invention to provide a composite display card which is durable in construction, yet maintains its attractive appearance under varying conditions of use.

It is an even further object of the invention to provide a composite display card which is easily and conveniently inserted in an envelope, greeting card, or the like.

To accomplish these and other objects, a three dimensional display card is provided which includes multiple components of different materials. The first component consists of a flexible backing member preferably constructed of paper or cardboard. The backing member is planar and optionally includes decorative printing thereon. Secured to the backing member is a planar metallic member. The metallic member is smaller in size than the backing member, and one side is engraved with a selected message. The metallic member and backing member are secured together using an adhesive material preferably consisting of dual-sided adhesive tape. The tape is smaller than the metallic member so as to obscure its view in the assembled product. In addition, care is taken to insure that the metallic member is not positioned over any decorative printing on the backing member. The resulting product is easily inserted in a card, envelope, or the like. It has a unique three-dimensional appearance, is durable in construction, and may be made in a variety of sizes, as specified by the user.

These and other objects, features, and advantages of the invention will be described hereinafter in the following detailed description of a preferred embodiment and drawings thereof.

DETAILED DESCRIPTION OF A PREFERRED EMBODIMENT

Figure 1:
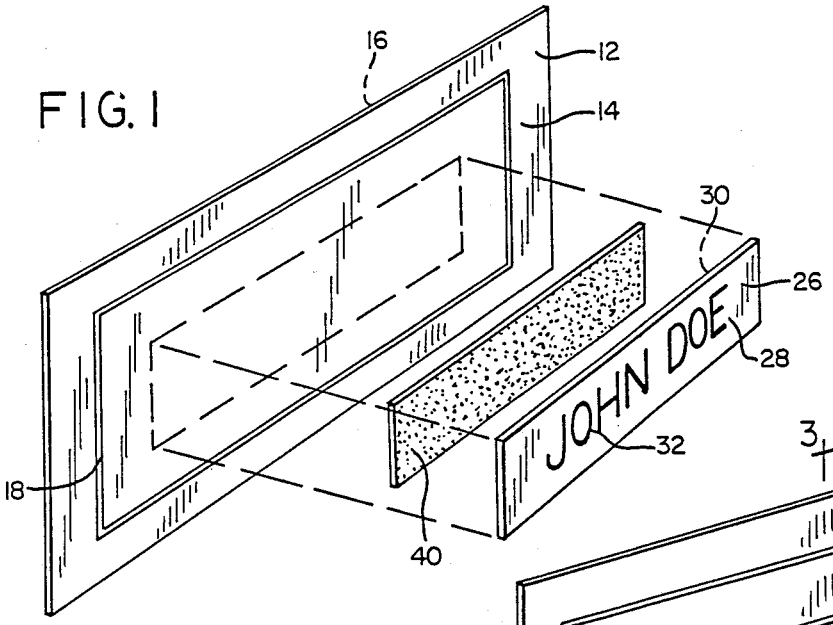
FIG. 1 is an exploded perspective view of the components used in manufacturing the invention.

The present invention involves a composite display card having a unique three-dimensional design. With reference to FIG. 1, the components used in manufacturing the card are illustrated. A flexible backing member 12 is first provided. It is planar in construction and preferably manufactured of a cellulosic fiber composition, namely, paper or cardboard. In addition, the backing member 12 should be of a uniform thickness ranging from 0.001 to 0.02 of an inch, with a thickness of about 0.009 of an inch being preferred. The length and width of the backing member 12 may be varied as desired.

The backing member 12 has a first side 14 and a second side 16. The first side 14 may optionally include a decorative printed portion 18, as specified by the end user.

Secured to the backing member 12 is a rigid planar metallic member 26 having a first side 28 and a second side 30. As shown in FIG. 1, the metallic member 26 is smaller in overall size than the backing member 12 in order to create a more balanced and pleasing visual effect in the final product.

The first side 28 of the metallic member 26 may be colored as desired, and includes decorative engraved indicia 32 as illustrated. The second side 30 of the metallic member 26 is smooth along its entire surface. The decorative engraved indicia 32 within the surface of the first side 28 does not cause any physical disruption in the planarity of the second side 30.

The metallic member 26 is of a uniform thickness ranging from about 0.02 to 0.04 of an inch, with a thickness of 0.025 of an inch being preferred. In addition, the metallic member 26 is preferably manufactured from aluminum or brass.

If modern, automated engraving equipment is used, the metallic member 26 may originally be part of a long metal sheet which includes multiple engravings. This sheet is then cut into individual portions of a size smaller than the backing member 12, as described above.

A variety of materials may be used to adhere the metallic member 26 to the backing member 12, including glue and other conventional adhesives. However, it is preferred that a tape portion 40 be used, both sides of which have adhesive material thereon. Such a product is commercially manufactured by a number of companies, including Cal-Pro, Inc. and Minnesota Mining & Mfg. The tape portion 40 is smaller than the backing member 12 and metallic member 26 so that it will be obscured from view in the final product. It should be of uniform thickness, preferably between 0.002 and 0.008 of an inch.

Figure 2:
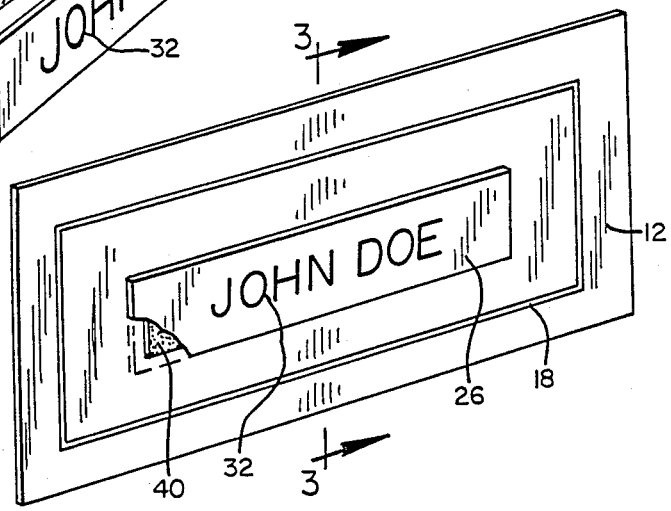
FIG. 2 is a perspective view of the assembled invention.
Figure 3:
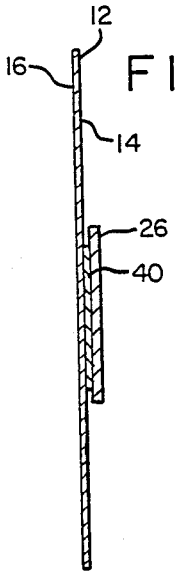
FIG. 3 is a cross sectional view taken along lines 3—3 of FIG. 2.

To assemble the final product shown in FIGS. 2 and 3, the tape portion 40 is initially secured either to the first side 14 of the backing member 12, or the second side 30 of the metallic member 26. If the tape portion 40 is initially secured to the first side 14 of the backing member 12, the second side 30 of the metallic member 26 is then positioned on the tape portion 40 and pressure is applied to complete adhesion. However, it is very important that the metallic member 26 be properly aligned relative to the backing member 12 so that the metallic member 26 will not obscure any decorative printing 18.

If the tape portion 40 is first adhered to the second side 30 of the metallic member 26, then the entire unit consisting of the metallic member 26 and tape portion 40 is pressed downward against the first side 14 of the backing member 12, again making sure that the metallic member 26 is properly aligned.

FIG. 3 shows a cross sectional view of the final product. It should be noted that the metallic member 26 is completely parallel with the backing member 12. This is facilitated by the uniform thickness of the backing member 12, metallic member 26, and tape portion 40. The resulting product is three dimensional in character, yet sufficiently flat to enable its insertion in greeting cards, envelopes, or the like. Likewise, the non-resilient character of the metallic member 26 prevents damage or disruption to the entire unit should slight bending forces be applied thereto during transit or use.

Figure 4:
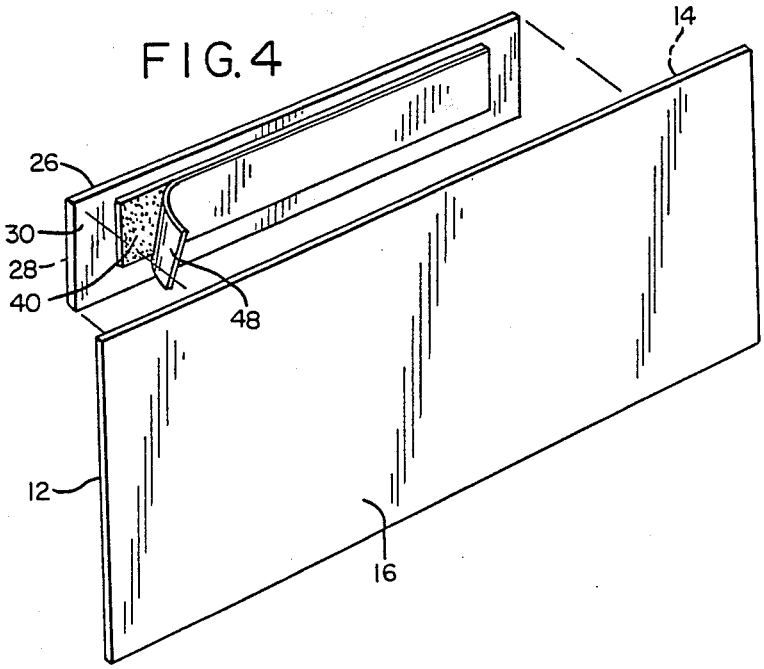
FIG. 4 is an exploded perspective view of an alternative form of the invention.

It is further contemplated that the display card system of the present invention may be supplied to the end user in kit form. The components used for this purpose are illustrated in FIG. 4. They are identical to those in the embodiment of FIGS. 1–3, with the exception of the tape portion 40. When supplied in kit form, one side of the tape portion 40 is pre-adhered to the second side 30 of the metallic member 26, with the opposite side of the tape portion 40 having a removable tab 48. This is shipped with the backing member 12 to the end user who then removes the tab 48 and adheres the metallic member 26 to the first side 14 of the backing member 12, making sure that alignment between these components is proper. In the alternative, the tape portion 40 may be initially adhered to the first side 14 of the backing member 12, with the subsequent removal of tab 48 and adhesion to the second side 30 of the metallic member 26.

Having herein described a preferred embodiment of the invention, it is contemplated that suitable changes and/or modifications may be made by those skilled in the art without departing from the scope of the invention. Therefore, the invention shall be defined only as indicated in the following claims:

What is claimed is:

1. A method for manufacturing a three dimensional composite display card comprising:

selecting a planar backing member made of a flexible material selected from the group consisting of paper and cardboard, said backing member having first and second sides;

selecting a planar metallic member having first and second sides, said second side being entirely smooth along the surface thereof:

engraving a selected message in the surface of said first side of said metallic member:

adhering said first side of said backing member to said second side of said metallic member using an adhesive material in a manner wherein said metallic member and said backing member, when secured together, are parallel to each other.

2. The method of claim 1 wherein said metallic member is made of a material selected from the group consisting of aluminum and brass.

3. The method of claim 1 wherein said metallic member is reduced in size by cutting so that it is smaller than said backing member.

4. The method of claim 1 further comprising the step of applying decorative printing to said first side of said backing member prior to the adhesion thereof to said metallic member.

5. The method of claim 4 further comprising the step of aligning said metallic member relative to said backing member so as to prevent said metallic member from obscuring said printing on said first side of said backing member.

6. The method of claim 1 wherein said second side of said metallic member is secured to said first side of said backing member using a planar portion of tape smaller in size than both said metallic member and said backing member, said tape having first and second sides each having adhesive materials thereon.

7. The method of claim 6 wherein the thickness of said tape is about 0.002 to 0.008 of an inch.

8. The method of claim 1 wherein the thickness of said metallic member is about 0.02 to 0.04 of an inch.

9. The method of claim 1 wherein the thickness of said backing member is about 0.001 to 0.02 of an inch.

10. A method for manufacturing a three dimensional composite display card comprising:

selecting a planar backing member made of a flexible material selected from the group consisting of paper and cardboard, said backing member having first and second sides;

applying decorative printing to said first side of said backing member;

selecting a planar metallic member having first and second sides, said second side being entirely smooth along the surface thereof and said first side having a selected message engraved in the surface thereof, said metallic member being smaller in size than said backing member;

securing a planar portion of tape having first and second sides each having adhesive materials thereon to at least one of said first side of said backing member and said second side of said metallic member, said portion of tape being smaller in size than both said metallic member and said backing member;

aligning said metallic member relative to said backing member so as to prevent said metallic member from obscuring said printing on said first side of said backing member when said metallic member is adhered thereto; and adhering said metallic member to said backing member using said tape in a manner wherein said metallic member and said backing member, when secured together, are parallel to each other.

11. A method of manufacturing a three dimensional composite display card comprising:

selecting a planar backing member made of a flexible material selected from the group consisting of paper and cardboard, said backing member having first and second sides;

selecting a planar metallic member having first and second sides, said second side being entirely smooth along the surface thereof and said first side having a selected message engraved in the surface thereof, said metallic member being smaller in size than said backing member;

providing a portion of tape having first and second sides each having adhesive materials thereon, said first side being adhered to said second side of said metallic member, with said second side of said tape being adhered to a removable tab;

aligning said metallic member with said backing member prior to the adhesion thereof together;

removing said removable tab from said second side of said tape;

urging said tape and attached metallic member into contact with said first side of said backing member so as to adhere said metallic member and backing member together in a manner wherein said metallic member and said backing member, when secured together, are parallel to each other.

* * * * *